US006170709B1

(12) United States Patent
Huang

(10) Patent No.: US 6,170,709 B1
(45) Date of Patent: Jan. 9, 2001

(54) HOT-MELTED ADHESIVE GUN

(76) Inventor: Hsiu-O Huang, 90-3, Lane 281, Shan Ming Rd., Hsiao Gang Sec., Kao Hsiung (TW)

( * ) Notice: Under 35 U.S.C. 154(b), the term of this patent shall be extended for 0 days.

(21) Appl. No.: 09/513,102

(22) Filed: Feb. 25, 2000

(51) Int. Cl.[7] ..... B07D 5/62
(52) U.S. Cl. ..... 222/146.5; 239/390; 239/397
(58) Field of Search ..... 222/146.5; 239/390, 239/397

(56) References Cited

U.S. PATENT DOCUMENTS 5,529,245 * 6/1996 Brown ..... 239/390
5,664,701 * 9/1997 Massena ..... 222/146.5
5,881,912 * 3/1999 Bokros ..... 222/146.5 X
5,881,924 * 3/1999 Bokros ..... 222/146.5
6,041,972 * 3/2000 Maayeh et al. ..... 222/146.5 X

* cited by examiner

*Primary Examiner*—Kenneth Bomberg
(74) *Attorney, Agent, or Firm*—Alan Kamrath

(57) ABSTRACT

A hot-melted adhesive gun has a holding portion, a barrel, a hot-melted device disposed in the barrel, a front casing, and a rear casing. The holding portion has a button, a circular hole, a male socket, and a support plate. The hot-melted device has a main pipe, an electric heater, a rear pipe, and an injection nozzle. The tube is inserted in a circular hole of the holding portion. The hot-melted device is inserted in the hollow casing. The front casing is disposed on a front portion of the hollow casing. The hollow casing is disposed on the support plate and in front of the rear casing.

3 Claims, 5 Drawing Sheets

HOT-MELTED ADHESIVE GUN

BACKGROUND OF THE INVENTION

The present invention relates to a hot-melted adhesive gun. More particularly, the present invention relates to a hot-melted adhesive gun which can receive or replace an adhesive rod easily.

Referring to FIGS. 1 and 2, a conventional hot-melted adhesive gun has a handle portion 10, a barrel portion 11, a propeller device 13 disposed on an upper portion of the handle portion 10, a hot-melted device 2 disposed in the barrel portion 11, an injection nozzle 22 disposed on a front portion of the barrel portion 11, and a trigger 12 disposed on a front portion of the handle portion 10. The hot-melted device 2 has a pipe 21, an electric heater 23 disposed on a lower portion of the pipe 21, and a soft tube 25 connected to the pipe 21. A conductive wire 24 is connected to the electric heater 23. An electric wire 4 is connected to the conductive wire 24. The trigger 12 drives the propeller device 13 to move. A hot-melted adhesive rod 3a is inserted in the soft tube 25 and the pipe 21. When the propeller device 13 moves forward, a hot-melted adhesive will be ejected via the injection nozzle 22. When a colorful hot-melted adhesive rod replaces the original hot-melted adhesive rod 3*a*, a residual hot-melted adhesive should be ejected entirely. Therefore, the residual hot-melted adhesive will be wasted.

SUMMARY OF THE INVENTION

An object of the present invention is to provide a hot-melted adhesive gun which can receive a first adhesive rod and replace the first adhesive rod with a second adhesive rod without wasting a residual hot-melted adhesive of the first adhesive rod.

Accordingly, a hot-melted adhesive gun comprises a holding portion, a barrel, a hot-melted device disposed in the barrel, a front casing, and a rear casing. The holding portion has a button, an insertion hole receiving the button, a spring enclosing a middle portion of the button, a pressing end disposed on a bottom of the button and out of the insertion hole, a blocking portion adjacent to the circular hole, a male socket, and a support plate. The male socket has an oblong hole and an upper face. The barrel has a hollow casing, a through hole, and a guide groove. The front casing has a round aperture and a rear flange. The rear casing has a tube, and a female socket. The tube has an elastic click plate contacting a bottom of the button. The hot-melted device has a main pipe, an electric heater disposed on a lower portion of the main pipe, a rear pipe connected to the main pipe, and an injection nozzle disposed on a front portion of the main pipe. Two conductive rods are connected to the electric heater. The tube is inserted in the circular hole of the holding portion. The elastic click plate engages with the blocking portion. The female socket engages with the male socket. The female socket has two through apertures receiving the conductive rods. Two conductive wires are connected to the conductive rods. Two electric wires are connected to the conductive rods. The male socket receives the conductive wires. The hot-melted device is inserted in the hollow casing. The injection nozzle passes through the through hole of the hollow casing. The front casing is disposed on a front portion of the hollow casing. The hollow casing is disposed on the support plate and in front of the rear casing. The rear pipe is inserted in the tube.

DETAILED DESCRIPTION OF THE INVENTION

Figure 1:
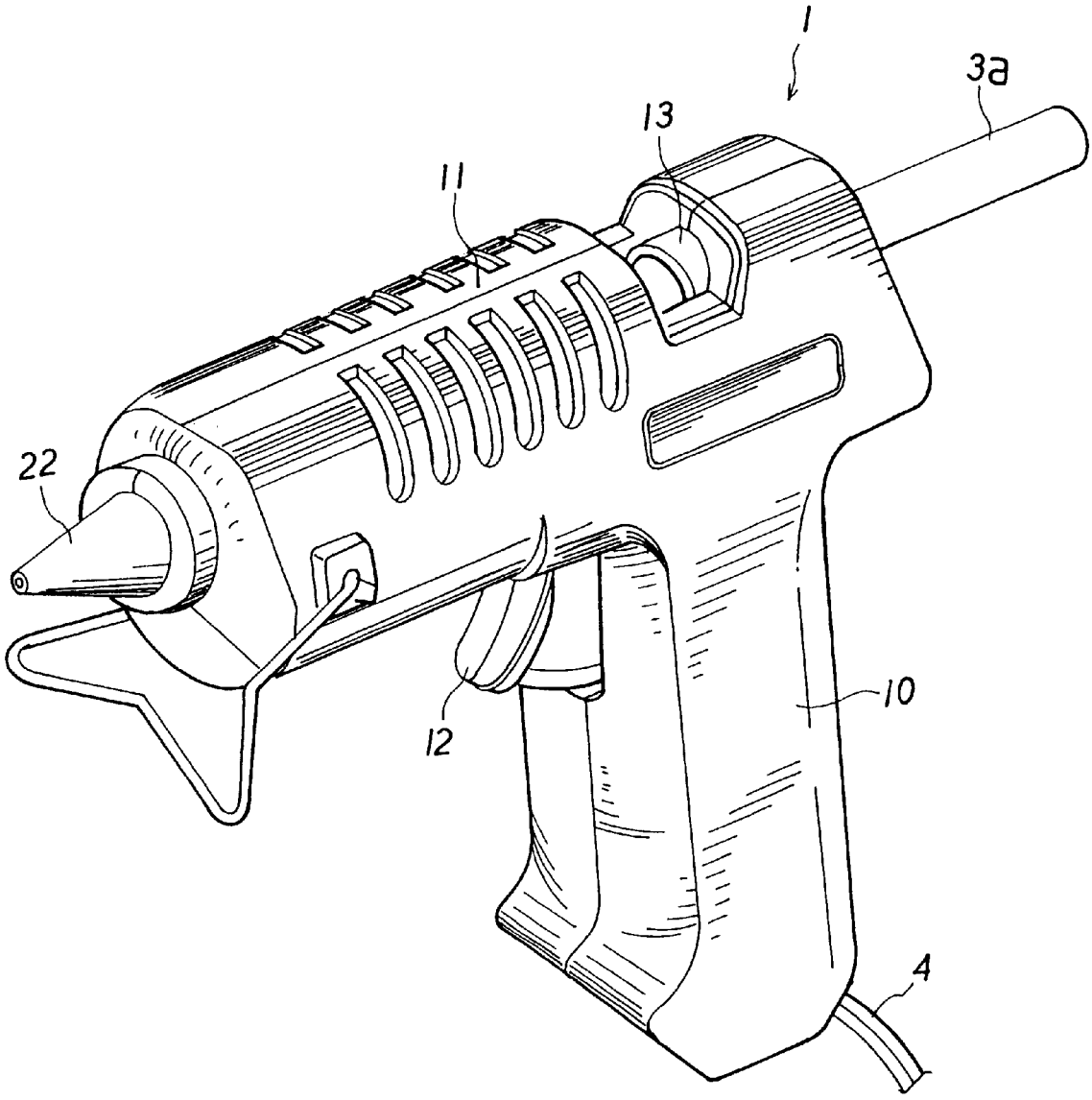
FIG. 1 PRIOR ART
FIG. 1 is a perspective assembly view of a hot-melted adhesive gun of the prior art.
Figure 2:
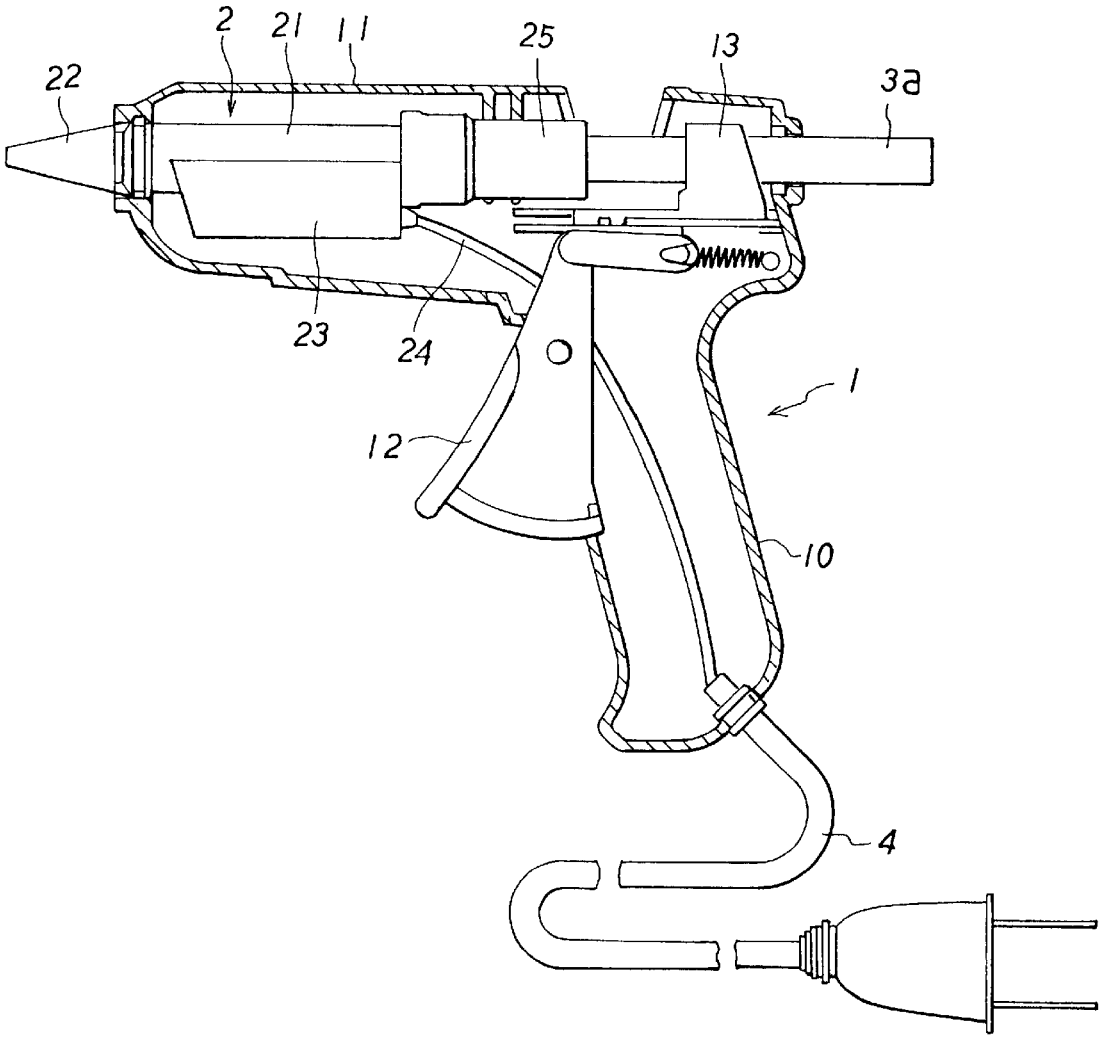
FIG. 2 PRIOR ART
FIG.2 is a sectional assembly view of a hot-melted adhesive gun of the prior art.
Figure 3:
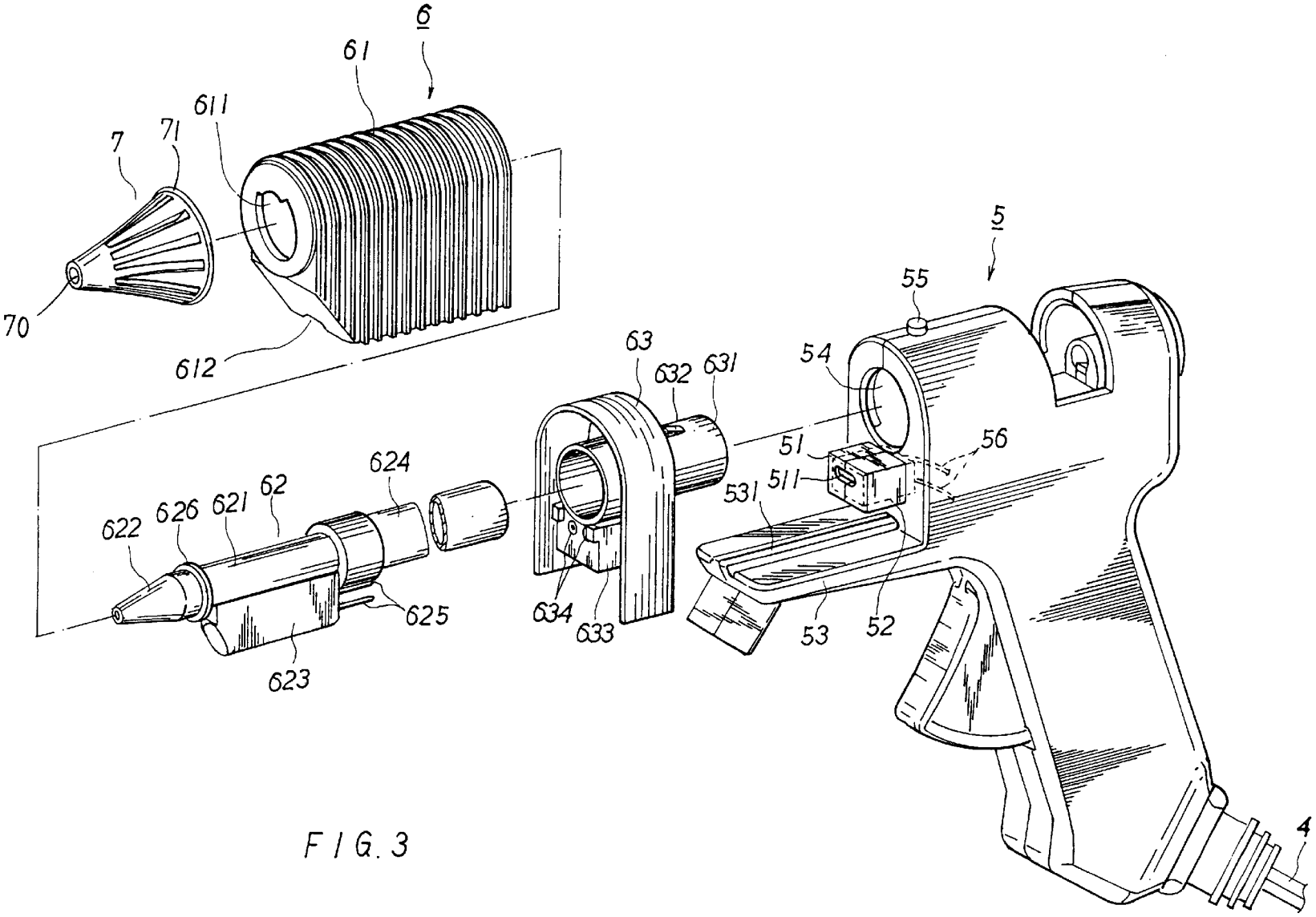
FIG. 3 is a perspective assembly view of a hot-melted adhesive gun of a preferred embodiment in accordance with the present invention.
Figure 4:
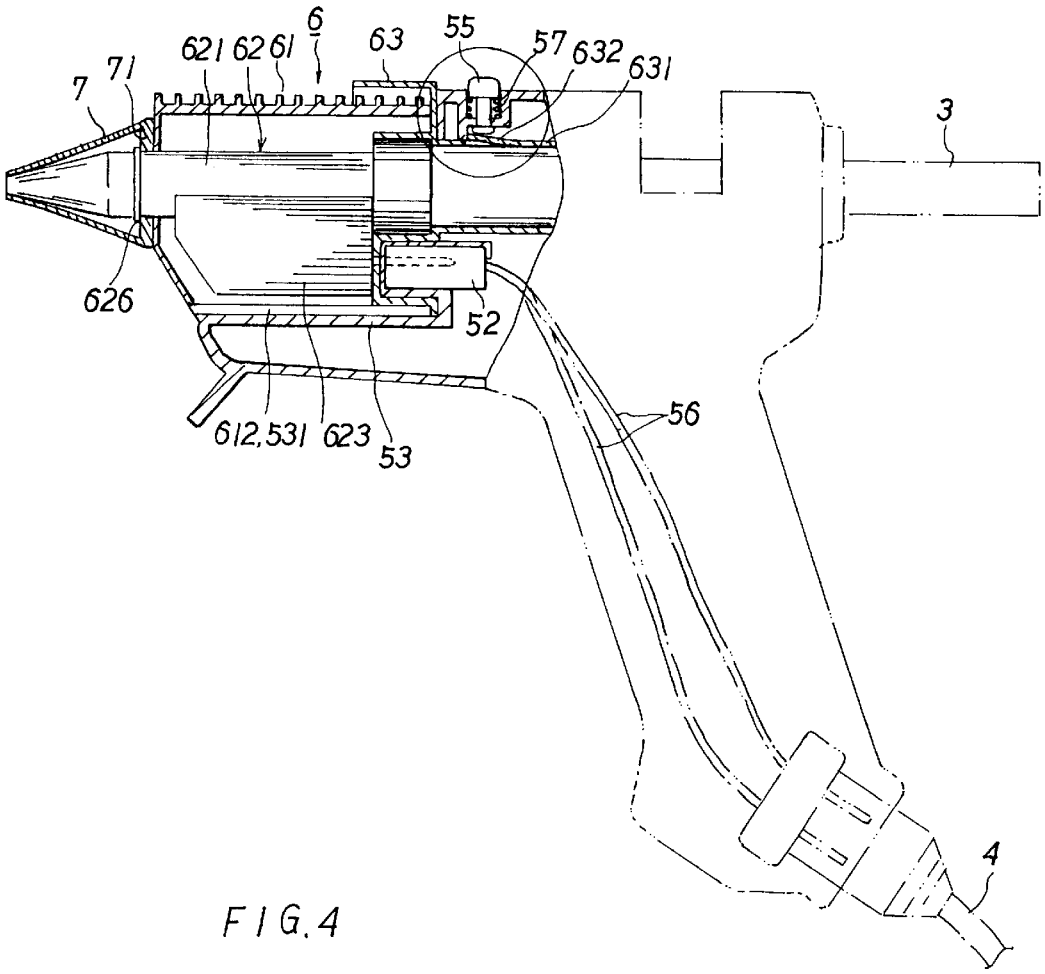
FIG. 4 is a partially sectional schematic view of a hot-melted adhesive gun of a preferred embodiment in accordance with the present invention.
Figure 4A:
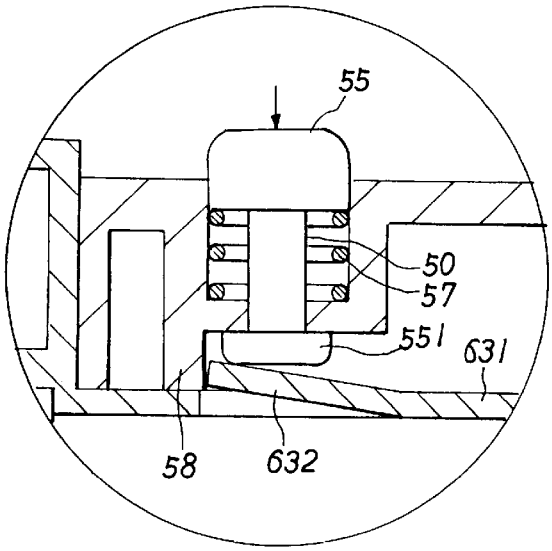
FIG. 4A is a partially sectional assembly view of a button, a spring, and an elastic click plate.

Referring to FIGS. 3, 4, and 4A first, a hot-melted adhesive gun comprises a holding portion 5, a barrel 6, a hot-melted device 62 disposed in the barrel 6, a front casing 7, and a rear casing 63.

The holding portion 5 has a button 55, an insertion hole 50 receiving the button 55, a spring 57 enclosing a middle portion of the button 55, a pressing end 551 disposed on a bottom of the button 55 and out of the insertion hole 50, a blocking portion 58 adjacent to the circular hole 54, a male socket 52, and a support plate 53. The male socket 52 has an oblong hole 511 and an upper face 51. The support plate 53 has a protruded bar 531.

The barrel 6 has a hollow casing 61, a through hole 611, and a guide groove 612.

The front casing 7 has a round aperture 70 and a rear flange 71.

The rear casing 63 has a tube 631, and a female socket 633. The tube 631 has an elastic click plate 632 contacting a bottom of the button 55.

The hot-melted device 62 has a main pipe 621, an electric heater 623 disposed on a lower portion of the main pipe 621, a rear pipe 624 connected to the main pipe 621, an injection nozzle 622 disposed on a front portion of the main pipe 621, and an annular flange 626 enclosing a rear portion of the injection nozzle 622. Two conductive rods 625 are connected to the electric heater 623.

The tube 631 is inserted in the circular hole 54 of the holding portion 5. The elastic click plate 632 engages with the blocking portion 58.

The female socket 633 engages with the male socket 52. The female socket 633 has two through apertures 634 receiving the conductive rods 625.

Two conductive wires 56 are connected to the conductive rods 625. Two electric wires 4 are connected to the conductive rods 625. The male socket 52 receives the conductive wires 56.

The hot-melted device 62 is inserted in the hollow casing 61 first. Then the injection nozzle 622 will pass through the through hole 611 of the hollow casing 61.

The front casing 7 is disposed on a front portion of the hollow casing 61. The annular flange 626 blocks the rear flange 71.

The hollow casing 61 is disposed on the support plate 53 and in front of the rear casing 63. The guide groove 612 of the hollow casing 61 receives the protruded bar 531. The rear pipe 624 is inserted in the tube 631.

When the button 55 is pressed downward, the elastic click plate 632 will be disengaged from the blocking portion 58. Therefore, the rear casing 63 can be detached from the holding portion 5 easily.

Figure 5:
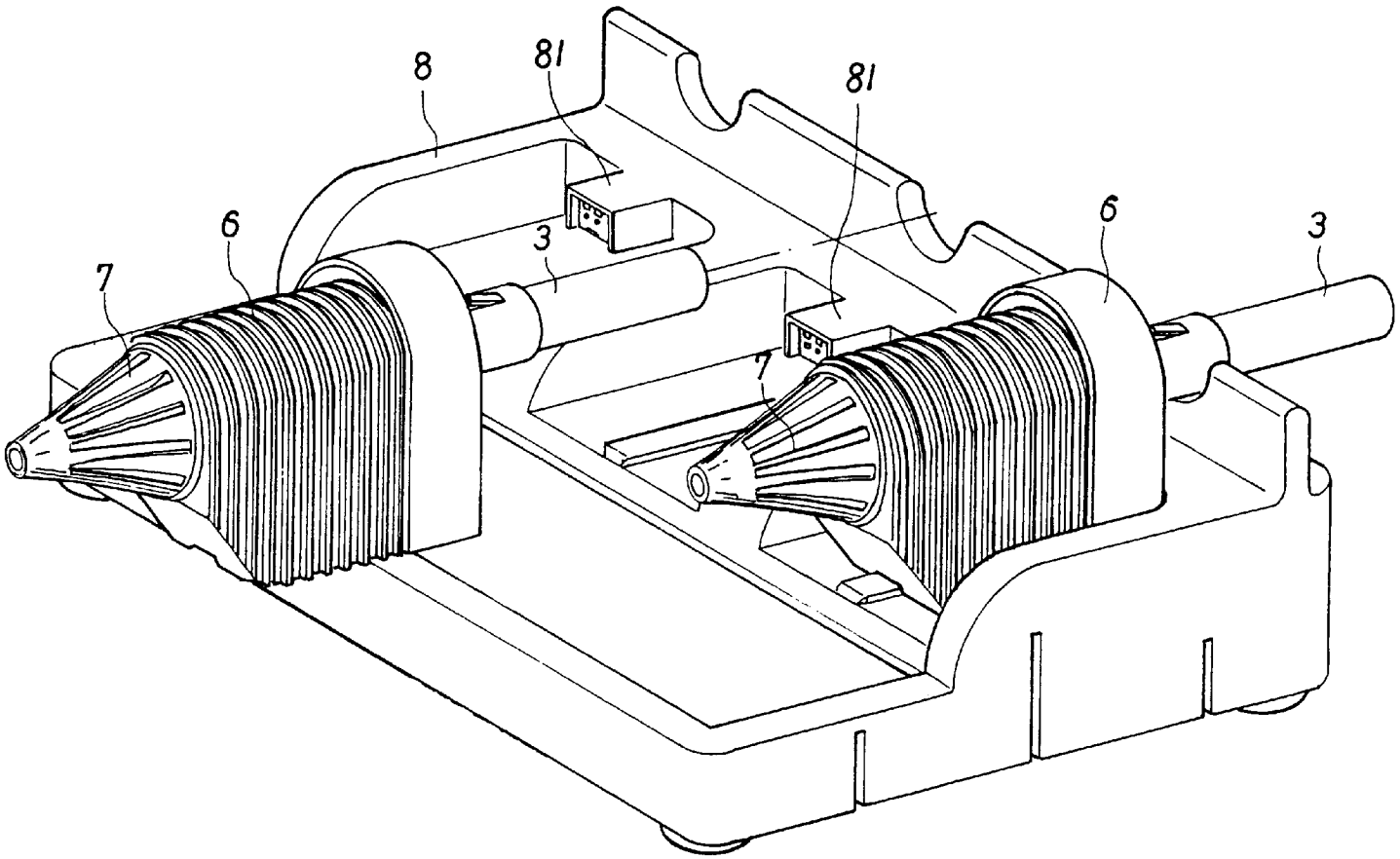
FIG. 5 is a perspective schematic view illustrating an application of a heat preservation seat.

Referring to FIG. 5, a heat preservation seat 8 has a plurality of positioning electric sockets 81. Each of the positioning electric sockets 81 engages with the respective female socket 633 while the holding portion 5 detaches from the rear casing 63.

The present invention is not limited to the above embodiment but various modification thereof may be made. Furthermore, various changes in form and detail may be made without departing from the scope of the present invention.

I claim:

1. A hot-melted adhesive gun comprises a holding portion, a barrel, a hot-melted device disposed in the barrel, a front casing, and a rear casing, the holding portion having a button, an insertion hole receiving the button, a spring enclosing a middle portion of the button, a pressing end disposed on a bottom of the button and out of the insertion hole, a blocking portion adjacent to the circular hole, a male socket, and a support plate, the male socket having an oblong hole and an upper face, the barrel having a hollow casing, a through hole, and a guide groove, the front casing having a round aperture and a rear flange, the rear casing having a tube, and a female socket, the tube having an elastic click plate contacting a bottom of the button, the hot-melted device having a main pipe, an electric heater disposed on a lower portion of the main pipe, a rear pipe connected to the main pipe, and an injection nozzle disposed on a front portion of the main pipe, two conductive rods connected to the electric heater, portion, the elastic click plate engaging with the blocking portion, the female socket engaging with the male socket, the female socket having two through apertures receiving the conductive rods, two conductive wires connected to the conductive rods, two electric wires connected to the conductive rods, the male socket receiving the conductive wires, the hot-melted device inserted in the hollow casing, the injection nozzle passing through the through hole of the hollow casing, the front casing disposed on a front portion of the hollow casing, the hollow casing disposed on the support plate and in front of the rear casing, and the rear pipe inserted in the tube.

2. The hot-melted adhesive gun as claimed in claim 1, wherein the support plate has a protruded bar.

3. The hot-melted adhesive gun as claimed in claim 1, wherein an annular flange encloses a rear portion of the injection nozzle, and the annular flange blocks the rear flange.

* * * * *